US005496094A

United States Patent [19]

Schwartzkopf et al.

[11] Patent Number: 5,496,094

[45] Date of Patent: Mar. 5, 1996

[54] SEAT WITH EXPANDABLE FRAME

[75] Inventors: Robert A. Schwartzkopf, Columbus, Ind.; Richard E. Cone, Athens, Ohio

[73] Assignee: Cosco, Inc., Columbus, Ind.

[21] Appl. No.: 384,608

[22] Filed: Feb. 3, 1995

Related U.S. Application Data

[63] Continuation of Ser. No. 130,006, Sep. 30, 1993, abandoned.

[51] Int. Cl.[6] ..... A47C 4/48

[52] U.S. Cl. ..... 297/45; 297/16.1; 297/56; 297/440.11; 5/98.2; 248/164

[58] Field of Search ..... 297/16.1, 24, 25, 297/45, 47, 55, 56, 183.1, 183.5, 183.7, 440.11, 452.13; 108/118; 248/164, 166, 188.6; 5/98.2, 98.3, 101, 102, 124, 126, 127, 655, 657

[56] References Cited

U.S. PATENT DOCUMENTS

| | | | |
|---|---|---|---|
| 1,960,022 | 5/1934 | Melder | 297/183.7 X |
| 2,473,090 | 6/1949 | Becker | 297/440.11 X |
| 2,649,894 | 8/1953 | Simmons | 248/164 |
| 2,689,602 | 9/1954 | Morgan | 297/452.13 X |
| 2,694,438 | 11/1954 | Frech | 297/440.11 X |
| 2,713,890 | 7/1955 | Mack | 297/440.11 X |
| 2,802,578 | 8/1957 | Barile | 108/118 X |
| 3,669,489 | 6/1972 | Rock | 297/183.5 X |
| 4,230,364 | 10/1980 | Parker | 297/460 |
| 4,494,796 | 1/1985 | Liebhold | 297/440.11 X |
| 4,532,948 | 8/1985 | Burrows | 297/45 X |
| 4,553,786 | 11/1985 | Lockett, III et al. | 297/440.11 X |

FOREIGN PATENT DOCUMENTS

| | | | |
|---|---|---|---|
| 109046 | 3/1940 | Australia | 297/25 |
| 332782 | 7/1930 | United Kingdom | 297/45 |

*Primary Examiner*—Peter R. Brown
*Attorney, Agent, or Firm*—Barnes & Thornburg

[57] ABSTRACT

A chair is provided which includes a first floor and seat engaging frame member and a second floor and seat engaging frame member pivotally joined to one another to permit collapsing of the chair from an erected seating position to a substantially coextensive position. In addition, the first and second frame members each include a substantially straight bight end portion angled with respect to the respective frame members. Also included is a seat surface-providing member of a shape having a first pocket for engaging and enclosing an extremity of the first bight of the first frame member and at a second end a second pocket for engaging and enclosing an extremity of the second bight of the second frame member. The first and second bight end portions provide the only support for the seat-supporting member.

20 Claims, 5 Drawing Sheets

SEAT WITH EXPANDABLE FRAME

BACKGROUND AND SUMMARY OF THE INVENTION

This is a continuation of application Ser. No. 130,006, filed Sep. 30, 1993, now abandoned.

This invention relates to folding chairs and, particularly, to a chair with an expandable frame. More particularly, the present invention relates to an infant chair having an expandable frame, a seat on the frame, and a brace for limiting the expansion of the frame to a seating orientation.

Individuals who have either small children or infants are quite aware of the inherent dangers which exist within a home. Infants often face the risk of falling off of tables and/or adult chairs when they are left unsecured for even a brief period of time. Even when a child is carefully placed on the floor, the risk of being accidently stepped on or tripped over still exists. What is needed is a folding infant chair which is light-weight and which can be set up quickly and easily so that it can be moved from room to room to provide an elevated seat for infants.

According to the present invention, a chair is provided to furnish a seat for a child. The chair includes first and second frame members movably joined to each other. The chair also includes a seat surface-providing member which engages the first and second members and bracing means which limits the movement of the first and second frame members with respect to each other.

In preferred embodiments, the infant chair is a tubular X-frame unit with a fabric seat cover that acts as a sling. The sling seat is supported by pockets formed in the seat that receive and hang onto back and front portions of the frame. The X-frame unit folds for portability. The frame is locked into place by bracing links on both sides that automatically lock when opened and need to be manually released to fold. A restraint system is included that is riveted to the seat frame. It includes a waist strap that is threaded from underneath the seat cover through a buttonhole in the cover.

Illustratively, the folding infant chair includes two inverted U-shaped frame members joined together at a common pivot point and a seat extending between the tops of the two U-shaped frame members and having pockets engaging the tops of the two U-shaped frame members to hold the seat on the frame. A locking latch is provided to prevent the user from unfolding the chair past its seating configuration. As the frame is unfolded to its seating configuration, the frame expands to form an X-shaped seat support member on either side of the seat and the seat extends across the tops of the U-shaped frame members to provide a chair for an infant.

Further, in a presently preferred embodiment, a locking latch is mounted on each leg of one of the inverted U-shaped frame members between the seat and the common pivot point to provide bracing means. The locking latch includes an L-shaped slot. One leg of the L-shaped slot extends across the length of the latch and the second leg of the L-shaped slot extends along the width of the latch toward the seat. A headed locking pin extends out from each leg of the other the frame member and through the L-shaped slot. When the frame is unfolded, the locking pin slides in the slot across the length of the latch. The user locks the frame in its seat-providing configuration by pushing the latch down toward the ground so that the locking pin slides into the second leg of the L-shaped slot.

A child restraint strap, having opposite ends, is attached to the chair between the latch and the frame. Two hollow frame members are also inserted onto the ends of the two inverted U-shaped frame member to raise the height of the chair to provide an elevated seat for an infant.

The two inverted U-shaped frame members include legs which have bent portions for expanding the width of the chair. These bent portions cause the width of the frame to be greater at the base than at the top where the seat is attached to it.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
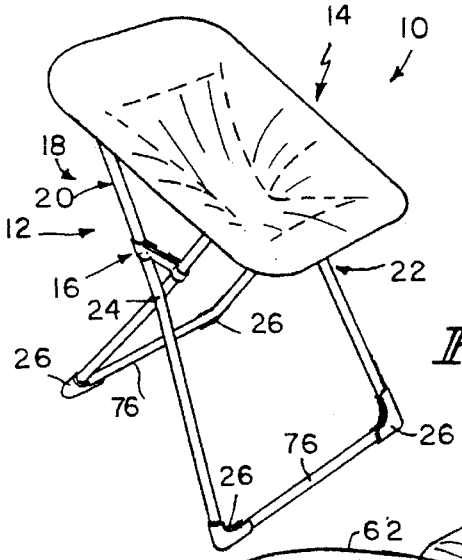
FIG. 1 is a perspective view of an infant chair showing a first frame member which is coupled to a second frame member, a seat extending between the first member and the second member, and a bracing strap engaging the first member and the second member so that the chair provides an elevated seating configuration.

A chair 10 in accordance with the present invention is shown in FIG. 1 as it would appear to a user about to place an infant into the chair 10. The chair 10 includes a frame 12, a seat-surface providing member 14 mounted on the frame 12, and a bracing strap 16 for preventing expansion of the frame 12 past its seat-providing orientation 18. The frame 12 includes a first frame member 20 and a second frame member 22 joined together by a frame screw 24. The seat-surface providing member 14 extends between the first frame member 20 and the second frame member 22. Stabilizing members 26 are mounted on the frame 12 to stabilize the chair 10 on a surface.

Figure 2:
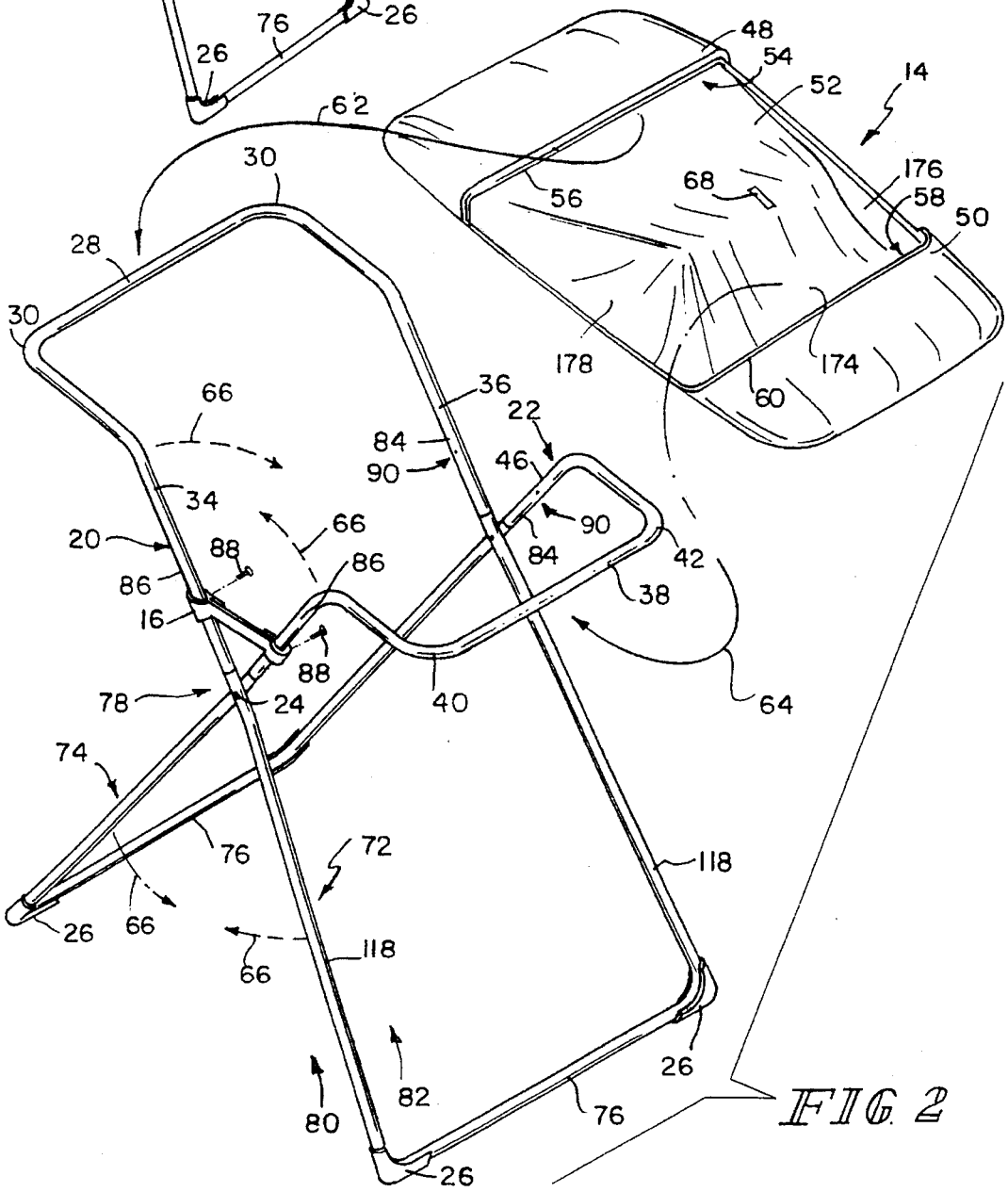
FIG. 2 is enlarged partly exploded perspective view of the chair illustrated in FIG. 1, showing the first frame member having a first upper bight portion, the second frame member having a second upper bight portion, the seat having a first pocket formed for extension over the first upper bight portion and a second pocket formed for extension over the second upper bight portion, a third U-shaped frame member being coupled to a lower end of the first frame member, and a fourth U-shaped frame member being coupled to lower ends of the second frame member so that the first and third frame members undergo folding movement with respect to the second and fourth frame members.

As shown in FIG. 2, the first frame member 20 includes a first upper bight portion 28 having opposed ends 30, 32, a first leg 34, and a second leg 36. The first leg 34 and the second leg 36 extend generally parallel to each other from said upper bight portion 28. The second frame member 22 includes a second upper bight portion 38 having opposed ends 40, 42, a first leg 44, and a second leg 46. The first leg 44 and the second leg 46 extend generally parallel to each other from the second upper bight portion 38. Ideally, the first leg 34 and the second leg 36 of the first frame member 20 extend generally parallel to each other from respective ends of said opposed ends 30, 32. Likewise, the first leg 44 and the second leg 46 of the second frame member 22 extend generally parallel to each other from respective ends of said opposed ends 40, 42. The seat-surface providing member 14 is formed to extend across the frame 12 between the first upper bight portion 28 and the second upper bight portion 38.

The seat-surface providing member 14, as shown in FIG. 2, includes a first end portion 48, a second end portion 50, and a middle portion 52 extending therebetween. The first end portion 48 is folded over the middle portion 52 to form a first pocket 54 which is fixed in the seat-surface providing member 14 by a seam 56. The second end portion 50 is also folded over the middle portion 52 to form a second pocket 58 which is fixed in the seat-surface providing member 14 by a second seam 60. The first pocket 54 is formed for extendable movement 62 over the upper bight portion 28 of the first frame member 20 and the second pocket 58 is formed for extendable movement 64 over the second upper bight portion 38 of the second frame member 22 so that the seat-surface providing member 14 is securely mounted on the frame 12 while the chair 10 is in its seat-surface providing orientation 18. Moreover, the middle portion 52 of the seat surface providing member 14 is formed to include a belt-receiving aperture 68 sized for insertion of a child restraint strap formed from a textile material therethrough (not shown in FIG. 2—see, for example FIG. 8) to fasten the child in the chair 10. The seat-surface providing member 14 may be inserted on and removed from the first frame member 20 and the second frame member 22 only following folding movement 66 of the first frame member 20 relative to the second frame member 22.

Ideally, the chair 10 includes a third frame member 72 and a fourth frame member 74, each member having a lower bight portion 76, as shown in FIG. 2. The first frame member 20 is mounted in the third frame member 72 and the second frame member 22 is mounted in the fourth frame member 74. It will be appreciated that the first frame member 20 and the second frame member 22 may be mounted to the third frame member 72 and fourth frame member 74 by pin, screw, adhesive, or comparable mounting means.

The first frame member 20 and the second frame member 22 are movably joined along a pivot axis 78 by frame screws 24 to form an exterior side 80 and an interior side 82 of the chair 10. The first legs 34, 44 and the second legs 36, 46 are further formed to include an inside face 84 positioned on the interior side 82 of the chair 10 and an outside face 86 positioned on the exterior side 80 of the chair 10. The frame screw 24 extends through the first frame member 20 and the second frame member 22, respectively, thereby positioning the inside face 84 of the first leg 34 and second leg 36 of the first frame member 20 adjacent to the outside face 86 of the first leg 44 and the second leg 46 of the second frame member 22.

The bracing strap 16, in one embodiment of the present invention, is formed from a flexible textile material as shown in FIG. 2. The strap 16 is affixed to the first frame member 20 and the second frame member 22 by screws 88 or the like which extend through the textile material of the strap 16 and into holes 90 formed the first frame member 20 and the second frame member 22. The flexible textile bracing strap 16 permits folding movement 66 of the first frame member 20 relative to the second frame member 22 and the third frame member 72 relative to the fourth frame member 74. It is appreciated that the chair 10 may braced in its seating orientation 18 by cables, hooks, or other comparable bracing means which prevent the extension of the first frame member 20 and second frame member 22 beyond the seating orientation 18.

Figure 3:
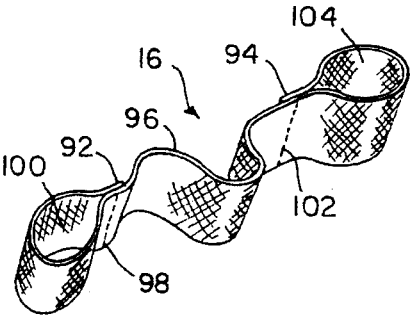
FIG. 3 is an enlarged perspective view of the bracing strap illustrated in FIG. 1.

As illustrated in FIG. 3, the bracing strap 16 includes opposite end portions 92, 94 and a central portion 96 extending therebetween. One opposite end portion 92 is fixed to the central portion 96 by a seam 98 to form a first bracing strap aperture 100 and the other opposite end portion 94 is fixed to the central portion 96 by a seam 102 to form a second bracing strap aperture 104. The first bracing strap aperture 100 is formed for insertion of the first frame member 20 therethrough and the second bracing strap aperture 104 is formed for insertion of the second frame member 22 therethrough.

Figure 4:
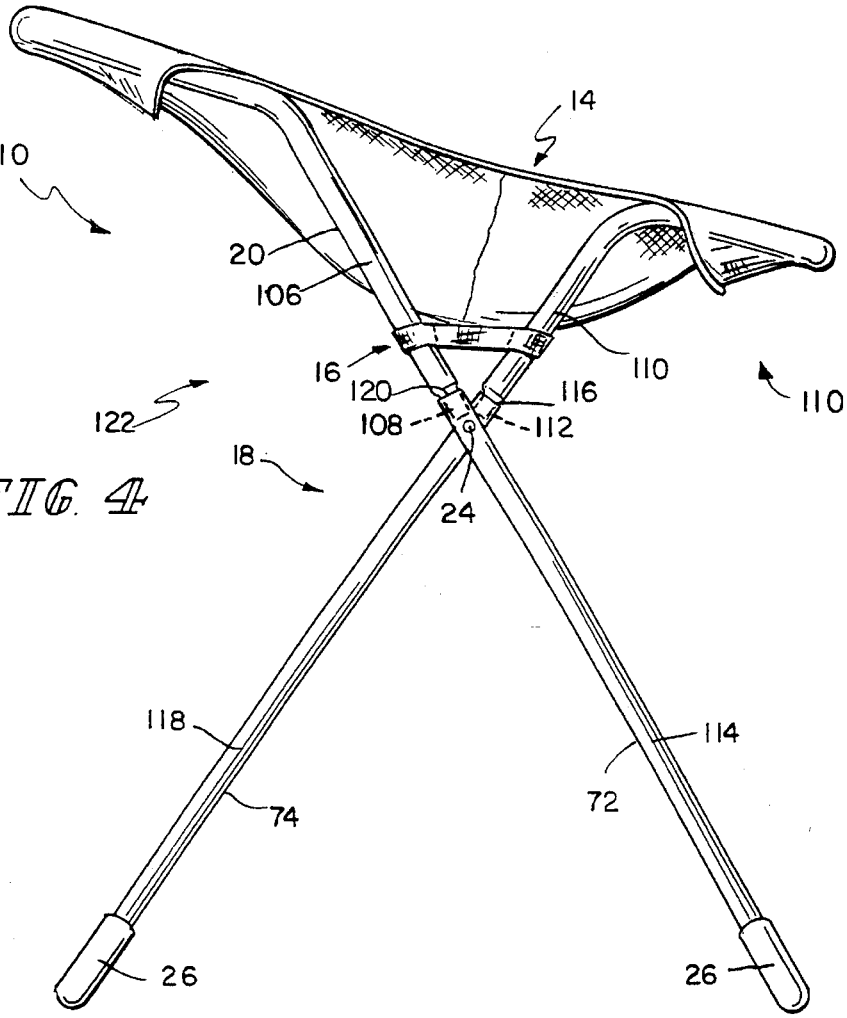
FIG. 4 is a side elevational view of the chair of FIG. 1 showing the first frame member having foot portions which extend into the third frame member and the second member having foot portions which extend into the fourth frame member.

In another embodiment of the present invention, the first leg 34 and the second leg 36 of the first frame member 20 each include an elongated portion 106 having a substantially uniform cross-section along most of its length and a foot portion 108 having a reduced cross-section, see for example FIG. 4. Furthermore, the first leg 44 and the second leg 46 of the second frame member 22 each include an elongated portion 110 having a substantially uniform cross-section along most of its length and a foot portion 112 having a reduced cross-section.

The third frame member 72 also includes elongated portions 114 extending upward from the lower bight portion 76. These elongated portions 114 include a larger but otherwise similar cross-sectional opening 116 relative to the first frame member 20. The fourth frame member 74 includes elongated portions 118 extending upward from the lower bight portion 76. These elongated portions 118 also have larger but otherwise similar cross-sectional opening 120 relative to the second frame member 22.

Each of the foot portions 108 of the first frame member 20 are insertable into the opening 116 of the third frame member 72 and each of the foot portions 112 of the second frame member 22 are insertable into the openings 120 of the fourth frame member 74 to provide an elevated seating orientation 122. The foot portions 108 of the first frame member 20 are each secured in the opening 116 by extending the frame screw 24 through the third frame member 72 and the foot portion 108 positioned in its opening 116 and through the fourth frame member 74 containing the foot portion 112 positioned in its opening 120. It is contemplated that the foot portions 108 and 112 may be secured in the openings 116, 120, respectively, by hooks, screws, rivets, adhesives, or other comparable securing means and that an elevated seating orientation 122 may be achieved by providing a first frame member 20 and a second frame member 22 each with an adjustable expandable elongated portions.

Figure 5:
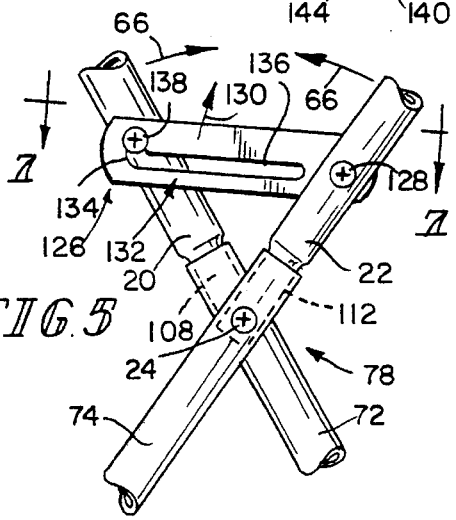
FIG. 5 is an enlarged fragmentary side elevational view of another embodiment of the chair illustrated in FIG. 1 showing a mechanical frame latch extending between the first and second frame members to lock the chair in the seat-providing configuration.

In another embodiment of the present invention, the chair 10 may be formed to include a mechanical frame latch 126 as shown in FIG. 5 for locking the chair 10 in the seat-providing orientation 18. The frame latch 126 extends between the first frame member 20 and the second frame member 22 above the frame screw 24 and is fixed to the second frame member 22 by a headed rivet, rod, screw, pin or comparable connection device 128 for pivotable movement 130 therewith. The frame latch 126 is formed to include a L-shaped slot 132. This L-shaped slot 132 includes a locking portion 134 and an unlocking portion 136. The first frame member 20 includes a headed locking pin 138 which extends outward from the first frame member 20 and through the L-shaped slot 132. It is contemplated that the locking pin 138 may include a headed rivet, screw, rod, or comparable connection device.

Figure 6:
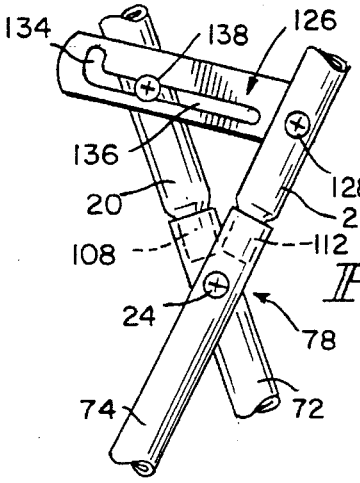
FIG. 6 is a view similar to FIG. 5 showing the mechanical frame latch as the X-shaped seat support frames are being folded to collapse the chair.

The frame latch 126 is shown in FIG. 5 as it would appear when the chair 10 is locked in its seat-providing orientation 18. The locking pin 138 is positioned in the locking portion 134 of the L-shaped slot 132. The pivoting movement 130 of the frame latch 126 on the second frame member 22 results in the locking pin 138 moving from the locking portion 134 to the unlocking portion 136. Thus, the first frame member 20 and the second frame member 22 undergo folding movement 66. As shown in FIG. 6, the locking pin 138 freely slides through the unlocking portion 136 of the L-shaped slot 132 once the locking pin 138 has been removed from the locking portion 138.

Figure 7:
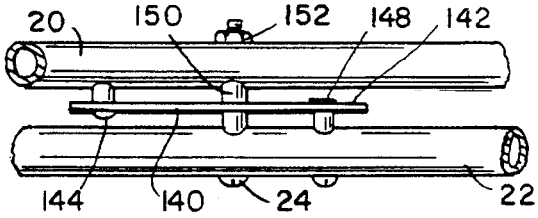
FIG. 7 is a view taken along line 7—7 of FIG. 5 showing the mechanical frame latch in its locked position.

As illustrated in FIG. 7, the frame latch 126 includes an outer side 140 and an inner side 142 and the locking pin 138 includes head portion 144. This head portion 144 engages the outer side 140 to movably couple the first frame member 20 to the frame latch 126. The rivet 128 which extends from the second frame member 22 includes a top portion 146 and a bottom portion 148. This bottom portion 148 engages the inner side 142 of the frame latch 126 to couple the frame latch 126 to the second frame member 22. Furthermore, the frame screw 24 extends through a spacer 150. The spacer 150 serves to separate the first frame member 20 and the second frame member 22. The frame screw 24 and spacer 150 are fastened to the chair 10 by a nut 152.

Figure 8:
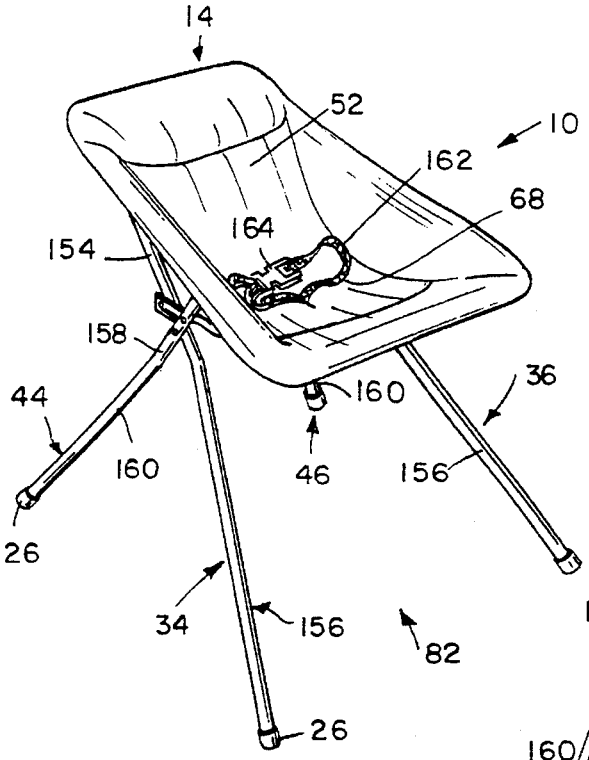
FIG. 8 is a perspective view of a preferred embodiment of an infant chair in accordance with the present invention showing angled legs extending downwardly from the upper bight portions of the first and second frame members and a child restraint strap extending through the seat.

As illustrated in FIG. 8, another preferred embodiment of the present invention includes the first leg 34 and the second leg 36 of the first frame member 20 each having a linear portion 154 extending downward from the upper bight portion 28 and a bent portion 156 angling outward from the interior side 82 of the chair 10 toward the floor surface. Furthermore, the first leg 44 and the second leg 46 of the second frame member 22 each include a second linear portion 158 extending downward from the second upper bight portion 38 and a second bent portion 160 angling outward from the interior side 82 of the chair 10 toward the floor surface. A child restraint strap 162 having a locking latch 164 also extends upwardly through the belt-receiving aperture 68 formed in the middle portion 52 of the seat-surface providing member 14.

Figure 10:
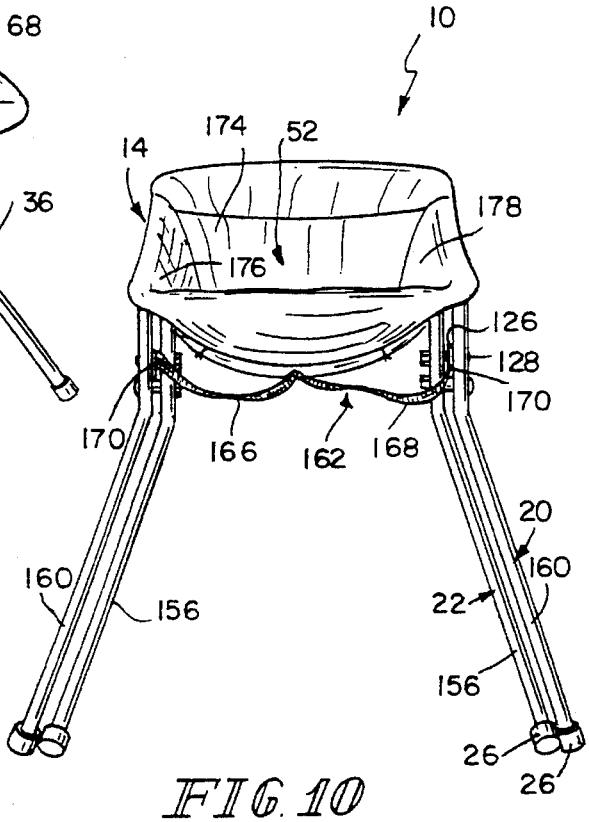
FIG. 10 is a front elevational view of the infant chair of FIG. 8 showing portions of the child restraint strap extending below the seat to attach to the frame.
Figure 9:
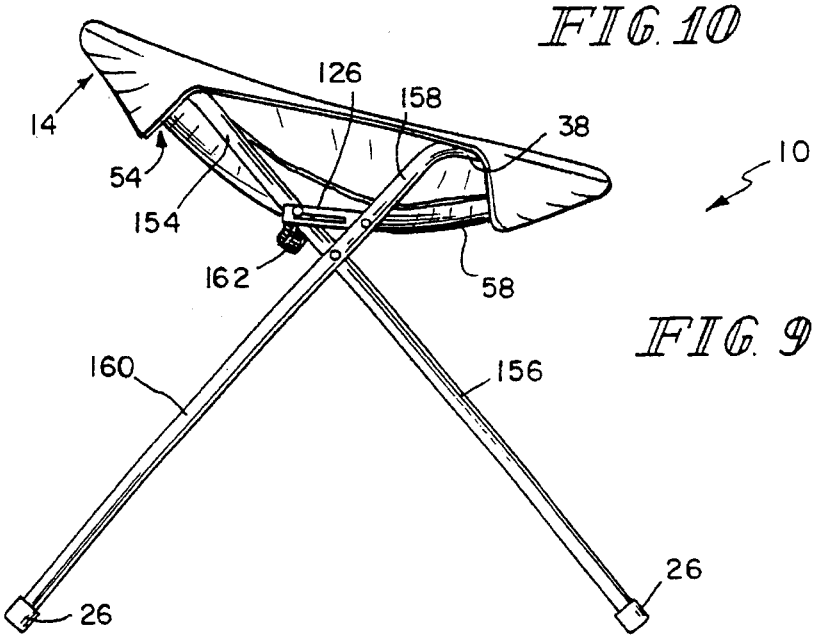
FIG. 9 is a side elevational view of the infant chair of FIG. 8.

The chair 10, having the bent portions 156, 160 and the frame latch 126 is locked in the seat-providing orientation 18 as shown in FIG. 9. Furthermore, as illustrated in FIG. 10, the child restraint strap 162 is formed to include two straps 166, 168 each having opposite ends 170, 172. One of the opposite ends 170 of each strap 166, 168 is attached to the first frame member 20 between the rivet 128 and the frame latch 126. The other opposite end portions 172 extend through the middle portion 52 of the seat-surface providing member 14.

Figure 11:
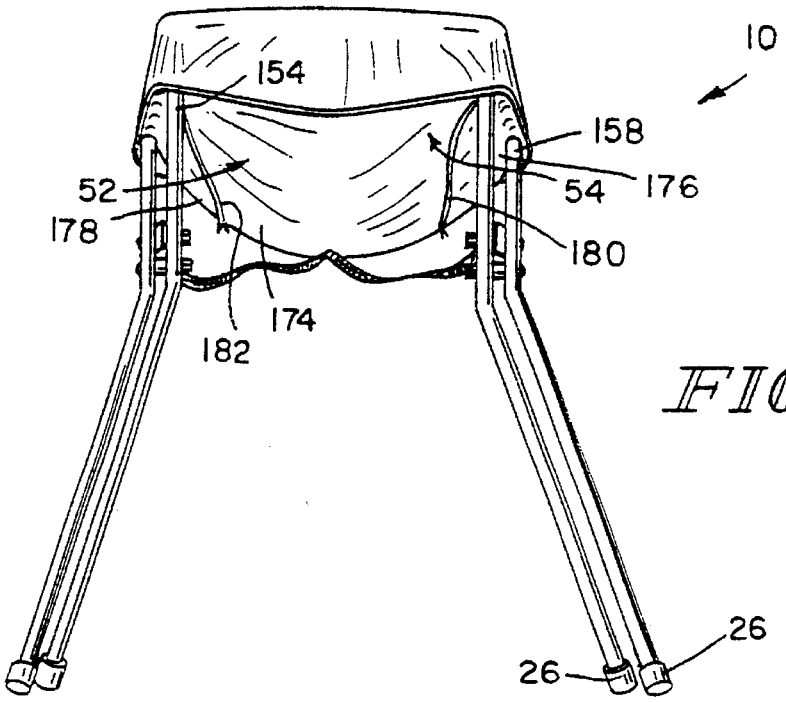
FIG. 11 is a rear elevational view of the infant chair of FIG. 8.

Ideally, the middle portion 52 of the seat-providing member 14 includes a seating segment 174 and two opposite wall segments 176, 178 coupled together by a third seam 180 and a fourth seam 182 as shown in FIG. 11. This seating segment 174 extends between the first pocket 54 and the second pocket 58 which are mounted on the upper bight portions 28, 38, respectively. Furthermore, the seating segment 174 sinks in a downward direction between the linear portions 154, 158 of the first frame member 20 and the second frame member 22, respectively, to provide a stabilized seat-providing orientation 18 for the infant.

Figure 12:
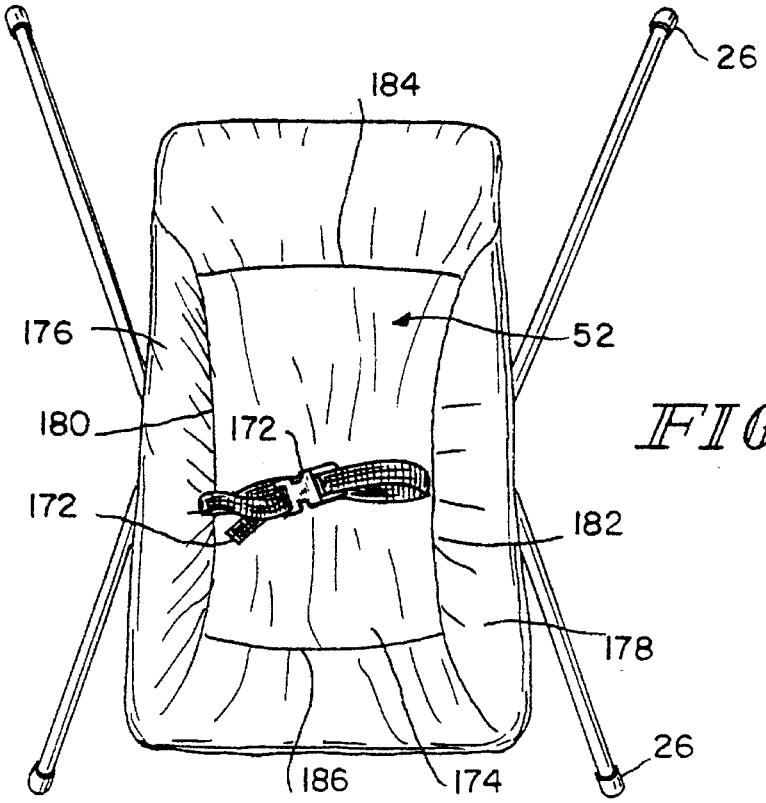
FIG. 12 is a top plan view of the infant chair of FIG. 8 showing angled legs extending outwardly in forward and rearward directions from the chair to provide a stable seating orientation.
Figure 13:
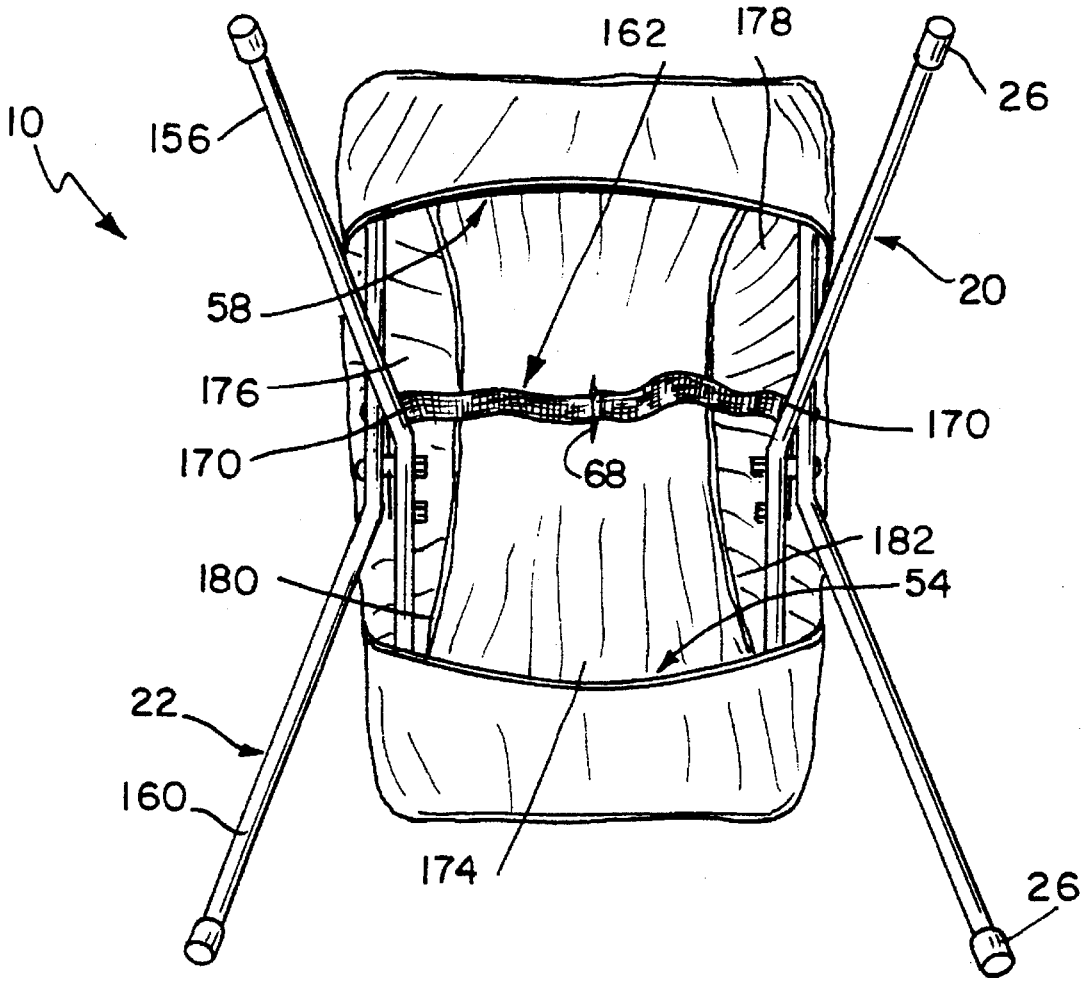
FIG. 13 is a bottom plan view of the infant chair of FIG. 8 showing a portion of the child restraint strap extending through a belt aperture formed in the seat.

As shown in FIG. 12, a first pocket seam 184 extends across the middle portion 52 between the first pocket 54 and the seating segment 174 and a second pocket seam 186 extends across the middle portion 52 between the second pocket 58 and the seating segment 174. Moreover, as illustrated in FIG. 13, the opposite wall segments 176, 178 extend along the length of the seating segment 174 and into both the first pocket 54 and the second pocket 58. These wall segments 176, 178 rise in an upward direction, see for example FIG. 10, so that the weight of the infant will be positioned below the upper bight portions 28, 38 of the first frame member 20 and second frame member 22, respectively.

Although the invention has been described in detail with reference to certain preferred embodiments, variations and modifications exist within the scope and spirit of the invention as described and defined in the following claims.

What is claimed is:

1. A chair comprising a first floor and seat engaging frame member and a second floor and seat engaging frame member pivotally joined to one another to permit collapsing of the chair from an erected seating position by pivoting of the first and second frame members to be substantially coextensive with one another, the first frame member having a substantially straight U-shaped first bight end portion angled with respect to the first frame member and the second frame member having a substantially straight U-shaped second bight end portion angled with respect to the second frame member, and a seat surface-providing member of a shape having at one end a first pocket for engaging and enclosing an extremity of the first angled bight of the first frame member and at a second end a second pocket for engaging and enclosing an extremity of the second angled bight of the second frame member, wherein the first and second bight end portions provide the only support for the seat-supporting member and with the remaining portions of the frame members providing no support for the seat-supporting member.

2. The chair of claim 1, wherein the first and second bight portions are only partially covered by the first and second pockets of the seat surface-providing member.

3. The chair of claim 1, further comprising an occupant restraint belt for securing an occupant in the chair, the seat surface-providing member including a belt-receiving aperture, and with an occupant restraint belt attached to the frame members to extend through the belt-receiving aperture to wrap around and restrain an occupant seated on the seat-providing surface.

4. The chair of claim 1, wherein the seat surface-providing member has widths which narrow from a widest point along its length as the seat surface-providing member gets closer to the two pockets.

5. The chair of claim 1, further comprising a frame latch pivotally attached to the second frame member and having an L-shaped slot extending between the first and second frame members, the first frame member including a locking pin extending outward therefrom and the L-shaped slot being sized for slidable movement of the locking pin therein.

6. The chair of claim 5, wherein the latch includes means for latching the pin in the L-shaped slot to lock the chair in a seating orientation.

7. The chair of claim 1, further comprising extensions attached to the first and second frame members at other ends thereof from the first and second angled end bights to provide an elevated seating orientation.

8. The chair of claim 7, wherein the extensions include means for stabilizing the chair on a floor surface.

9. The chair of claim 1, wherein the curved bottom wall has a first length between the pockets and the first and second pockets are shorter in length than the first length of the curved bottom wall.

10. The chair of claim 1, wherein the first and second pockets have a first width and the curved bottom wall is wider in width than said first width of said pockets so as to define a seating pouch segment for supporting an occupant between the two pockets.

11. The chair of claim 1, further comprising a bracing strap having opposite end portions and means for attaching one opposite end portion to the first frame member and the other opposite end portion to the second frame member.

12. A chair comprising a first floor and seat engaging frame member and a second floor and seat engaging frame member pivotally joined to one another to permit collapsing of the chair from an erected seating position by pivoting of the first and second frame members to be substantially coextensive with one another, the first frame member having a substantially straight first bight end portion angled with respect to the first frame member and the second frame member having a substantially straight second bight end portion angled with respect to the second frame member, a seat surface-providing member of a shape having at one end a first pocket for engaging the first angled bight of the first frame member and at a second end a second pocket for engaging the second angled bight of the second frame member, and wherein the first and second bight portions lie in a single plane when the chair is in its erected position.

13. The chair of claim 12, further comprising a bracing strap having opposite end portions and means for attaching one opposite end portion to the first frame member and the other opposite end portion to the second frame member.

14. A chair comprising a first floor and seat engaging frame member and a second floor and seat engaging frame member pivotally joined to one another to permit collapsing of the chair from an erected seating position by pivoting of the first and second frame members to be substantially coextensive with one another, the first frame member having a substantially straight U-shaped first bight end portion angled with respect to the first frame member and the second frame member having substantially U-shaped straight second bight end portion angled with respect to the second frame member, and a cover with a pocket on each end and spaced apart from one another by a middle portion, each pocket receiving and enclosing only a portion of one of the first and second bight portions, and wherein the first and second bight end portions provide the only support for the cover and with the remaining portions of the frame members providing no support for the cover.

15. The chair of claim 14, wherein the cover further includes a perimeter edge and a curved bottom wall suspended below the perimeter edge and positioned to lie between the spaced-apart pockets to support an occupant.

16. The chair of claim 15, wherein the spaced-apart pockets have a first width and the curved bottom wall is wider in width than said first width of said spaced-apart pockets.

17. The chair of claim 14, further comprising a bracing strap having opposite end portions and means for attaching one opposite end portion to the first frame member and the other opposite end portion to the second frame member.

18. A chair comprising a first floor and seat engaging frame member and a second floor and seat engaging frame member pivotally joined to one another to permit collapsing of the chair from an erected seating position by pivoting of the first and second frame members to be substantially coextensive with one another, the first frame member having a substantially straight first bight end portion angled with respect to the first frame member and the second frame member having substantially a straight second bight end portion angled with respect to the second frame member, a cover with a pocket on each end and spaced apart from one another by a middle portion, each pocket receiving and enclosing only a portion of one of the first and second bight portions, and wherein the first and second bight portions lie in a single plane when the chair is assembled.

19. The chair of claim 8, further comprising a bracing strap having opposite end portions and means for attaching one opposite end portion to the first frame member and the other opposite end portion to the second frame member.

20. A chair comprising a first floor and seat engaging frame member and a second floor and seat engaging frame member pivotally joined to one another to permit collapsing of the chair from an erected seating position by pivoting of the first and second frame members to be substantially coextensive with one another, the first frame member having a substantially straight first bight end portion angled with respect to the first frame member and the second frame member having substantially a straight second bight end portion angled with respect to the second frame member, a cover with a pocket on each end and spaced apart from one another by a middle portion, each pocket receiving and enclosing only a portion of one of the first and second bight portions, wherein the cover further includes a perimeter edge and a curved bottom wall suspended below the perimeter edge and positioned to lie between the spaced-apart pockets to support an occupant, and wherein the first and second bight end portions and the perimeter edge are substantially coplanar.

* * * * *